US008146294B1

(12) United States Patent
Bennett

(10) Patent No.: US 8,146,294 B1
(45) Date of Patent: Apr. 3, 2012

(54) DOOR LOCKING SYSTEM

(76) Inventor: Bruce C. Bennett, Henderson, NV (US)

( * ) Notice: Subject to any disclaimer, the term of this patent is extended or adjusted under 35 U.S.C. 154(b) by 259 days.

(21) Appl. No.: 12/687,218

(22) Filed: Jan. 14, 2010

(51) Int. Cl.
*E05B 55/00* (2006.01)

(52) U.S. Cl. ..... 49/449; 292/DIG. 9; 292/DIG. 46; 292/DIG. 47; 292/DIG. 15; 16/89

(58) Field of Classification Search ..... 49/449; 292/DIG. 9, DIG. 46, DIG. 47, DIG. 15; 16/89
See application file for complete search history.

(56) References Cited

U.S. PATENT DOCUMENTS

| | | | | | |
|---|---|---|---|---|---|
| 916,446 | A | * | 3/1909 | Hunt | 292/210 |
| 1,346,065 | A | * | 7/1920 | Spivak | 292/67 |
| 1,361,594 | A | * | 12/1920 | Lawson | 292/205 |
| 1,377,426 | A | * | 5/1921 | Olson | 292/281 |
| 1,416,035 | A | * | 5/1922 | Kelly | 292/207 |
| 1,515,091 | A | * | 11/1924 | Brower et al. | 292/204 |
| 1,557,305 | A | * | 10/1925 | Meerbott | 292/288 |
| 1,579,107 | A | * | 3/1926 | Hanle | 70/90 |
| 1,589,149 | A | * | 6/1926 | Hanle | 70/90 |
| 1,698,944 | A | * | 1/1929 | De Foe | 292/338 |
| 1,769,470 | A | * | 7/1930 | Shankland | 292/210 |
| 1,800,086 | A | * | 4/1931 | Larson | 292/338 |
| 2,121,490 | A | * | 6/1938 | Sasgen et al. | 292/338 |
| D120,752 | S | * | 5/1940 | Galliger | D8/330 |
| 2,356,427 | A | * | 8/1944 | Pressnall | 292/204 |
| 2,414,404 | A | * | 1/1947 | Youther | 292/338 |
| 2,516,630 | A | * | 7/1950 | Hufnagel | 292/163 |
| 2,606,053 | A | * | 8/1952 | Wingate, Jr | 292/338 |
| 2,768,850 | A | * | 10/1956 | Minnis, Jr | 292/3 |
| 3,572,796 | A | * | 3/1971 | Willner | 292/281 |
| 3,731,341 | A | * | 5/1973 | Woodruff | 16/82 |
| 3,837,693 | A | * | 9/1974 | Adickes | 292/207 |
| 3,938,838 | A | * | 2/1976 | Brakensiek | 292/210 |
| 4,068,875 | A | * | 1/1978 | Miller | 292/206 |
| 4,163,574 | A | * | 8/1979 | Chezem | 292/338 |
| 4,170,885 | A | | 10/1979 | Lundgren | |
| 4,263,853 | A | * | 4/1981 | Robertson | 105/378 |
| 4,379,576 | A | * | 4/1983 | Blough et al. | 292/205 |
| 4,395,065 | A | * | 7/1983 | Nelson et al. | 292/339 |
| 4,456,291 | A | * | 6/1984 | Brogie | 292/338 |
| 4,494,784 | A | * | 1/1985 | Haynes | 292/233 |
| 4,514,000 | A | * | 4/1985 | Chezem et al. | 292/338 |
| 4,514,020 | A | * | 4/1985 | Strasser | 312/220 |
| 4,673,203 | A | * | 6/1987 | Chezem | 292/339 |
| 4,757,642 | A | * | 7/1988 | Hahn | 49/449 |
| 4,822,086 | A | * | 4/1989 | Brown | 292/338 |
| 4,831,688 | A | * | 5/1989 | Deininger | 16/319 |
| 5,203,596 | A | * | 4/1993 | Stevens | 292/204 |
| 5,250,927 | A | * | 10/1993 | Nevels | 340/549 |
| D345,294 | S | * | 3/1994 | Palmer | D8/339 |
| 5,407,240 | A | * | 4/1995 | Andre et al. | 292/67 |
| 5,673,952 | A | * | 10/1997 | Chezem et al. | 292/338 |
| 6,000,735 | A | * | 12/1999 | Jourdenais | 292/238 |
| 6,367,852 | B1 | | 4/2002 | Aspenwall | |
| 7,093,320 | B2 | * | 8/2006 | Tager | 16/82 |
| 7,246,829 | B1 | * | 7/2007 | Balsbaugh et al. | 292/304 |
| D566,522 | S | | 4/2008 | Tobey et al. | |
| 7,937,806 | B1 | * | 5/2011 | Doyle | 16/82 |

* cited by examiner

*Primary Examiner* — Jerry Redman
*Assistant Examiner* — Clarence W Mayott, III

(57) ABSTRACT

A door locking system includes a first door and a second door positioned adjacent to each other and one of which is a sliding door. A mounting plate is mounted on the first door adjacent to the second door. A hinge plate has a hinged edge hingedly coupled to the mounting plate and is selectively positioned in a deployed position extending outwardly from the mounting plate. A stop includes a leg and an arcuate arm attached to the leg. The leg and arm are each hingedly coupled to the mounting plates and traverse the hinge plate. The stop releasably engages the hinge plate when the hinge plate is in the deployed position to retain the hinge plate in the deployed position and prevent the sliding of the first and second doors with respect to each other.

11 Claims, 10 Drawing Sheets

DOOR LOCKING SYSTEM

BACKGROUND OF THE DISCLOSURE

1. Field of the Disclosure

The disclosure relates to door lock devices and more particularly pertains to a new door lock device for preventing the opening of a sliding door.

2. Summary of the Disclosure

An embodiment of the disclosure meets the needs presented above by generally comprising a first door and a second door that are adjacent to each other and one of which is a sliding door. A mounting plate has a first side, a second side, a first lateral edge, a second lateral edge, an upper edge and a lower edge. The first side is attached to the first door at a position adjacent to the second door. A hinge plate has a hinged edge that is hingedly coupled to the mounting plate and a free edge positioned opposite of the hinged edge. The hinge plate is selectively positioned in a deployed position extending outwardly from the second side. A stop includes a leg that has a first end and a second end and an arcuate arm is attached to the leg. The first end of the leg is hingedly coupled to the mounting plate adjacent to the hinged edge of the hinge plate. A distal end of the arm with respect to the leg is hingedly coupled to the mounting plate to position the hinge plate between the first end of the leg and the distal end of the arm. The stop releasably engages the hinge plate when the hinge plate is in the deployed position to retain the hinge plate in the deployed position and prevent the sliding of the first and second doors with respect to each other.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
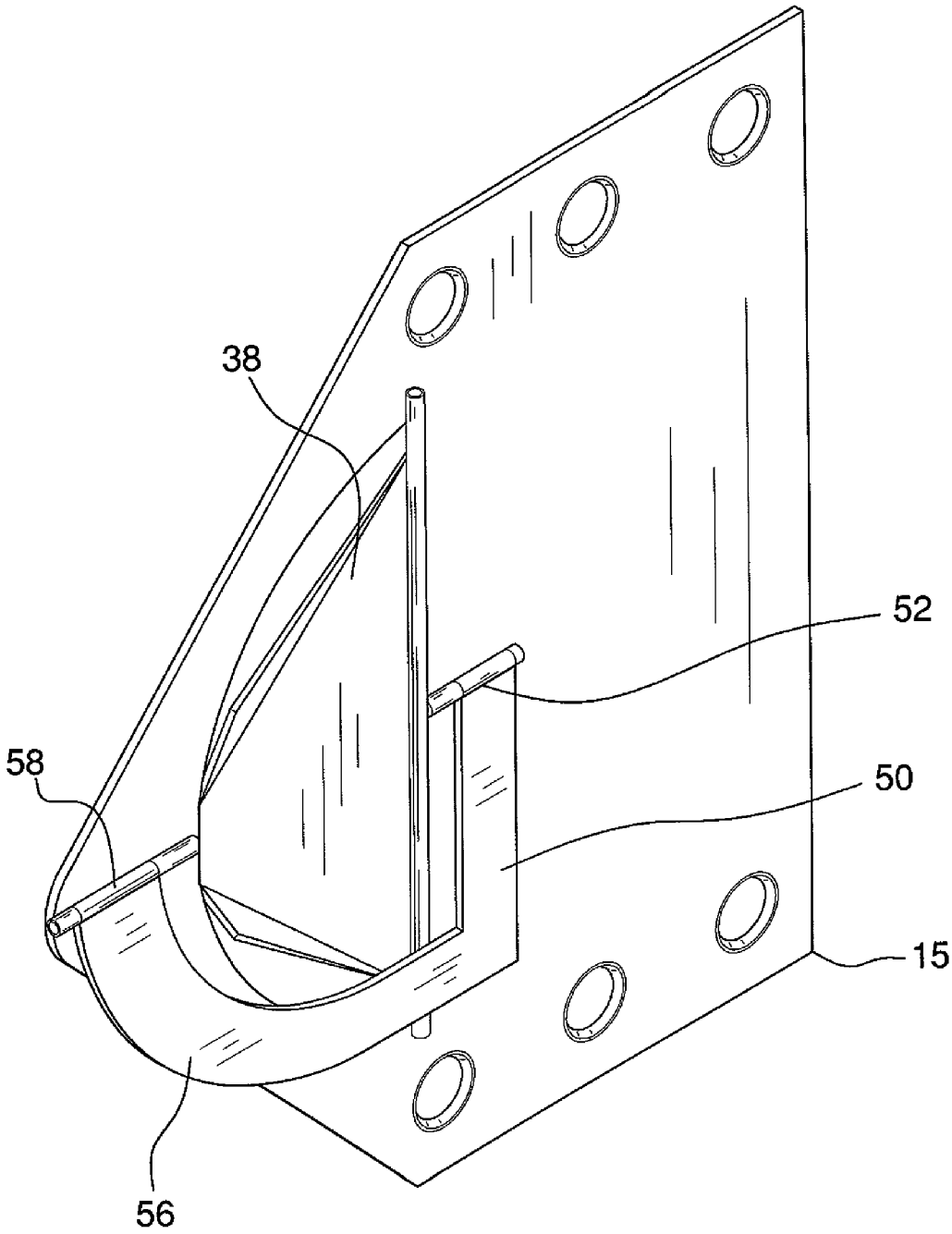
FIG. 1 is a front perspective view of a door locking system according to an embodiment of the disclosure.

With reference now to the drawings, and in particular to FIGS. 1 through 10 thereof, a new door lock device embodying the principles and concepts of an embodiment of the disclosure and generally designated by the reference numeral 10 will be described.

As best illustrated in FIGS. 1 through 10, the door locking system 10 generally comprises a first door 12 and a second door 14 that are adjacent to each other. At least one of the first 12 and second 14 doors is a sliding door, though each may be a sliding door or one may be a stationary door.

A mounting plate 15 has a first side 16, a second side 18, a first lateral edge 20, a second lateral edge 22, an upper edge 24 and a lower edge 26. The mounting plate 15 has an aperture 28 therein extending into the first side 16 and outwardly of the second side 18. The aperture 28 has a semi-circular shape including a linear edge 30 and an arcuate edge 32. The mounting plate 15 has a plurality of mounting openings 34 extending therethrough. Each of a plurality of fasteners 36 extends into one of the openings 34 and the fasteners 36 extend into the first door 12 at a position adjacent to the second door 14 to couple the first side 16 to the first door 12.

Figure 2:
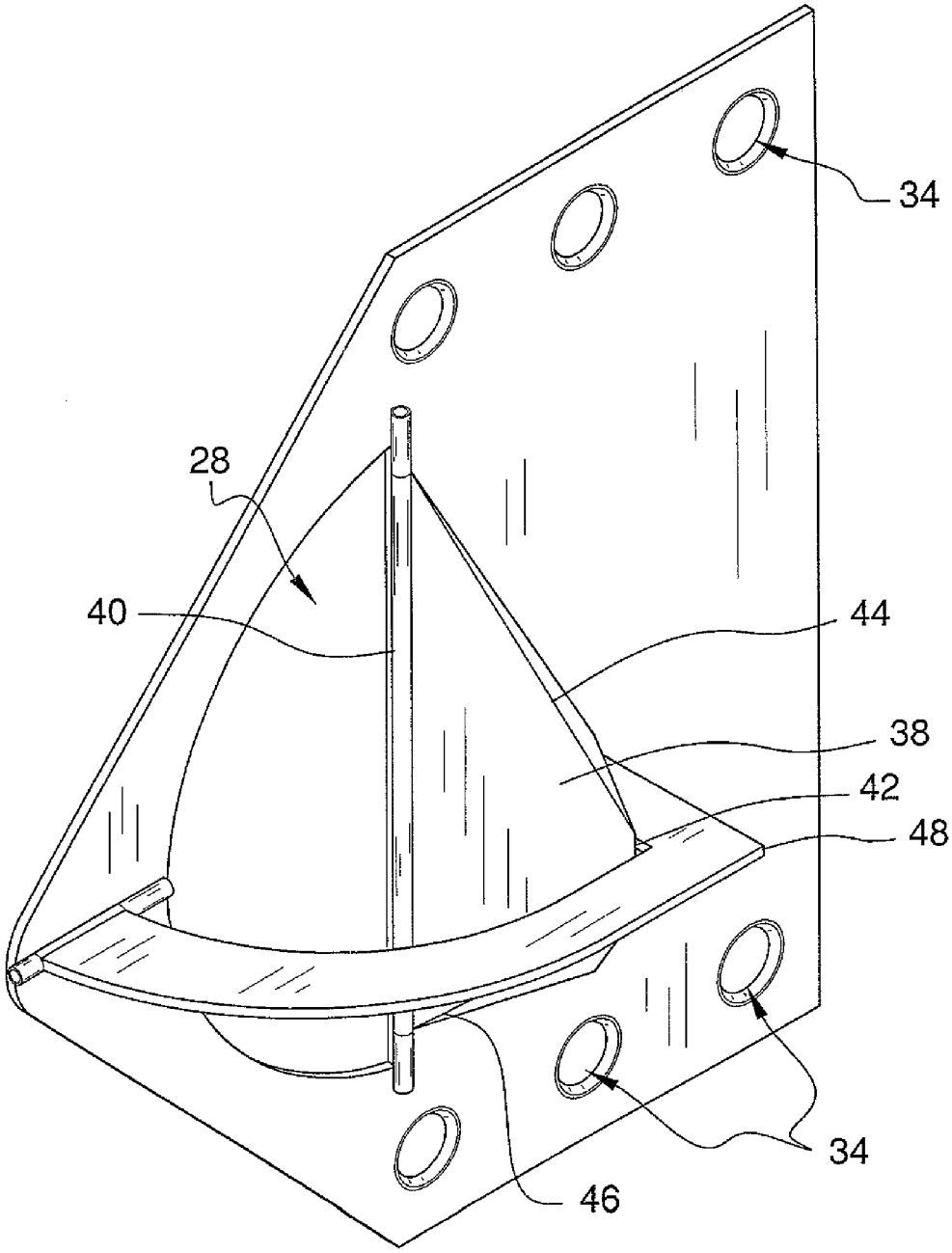
FIG. 2 is a front perspective view of an embodiment of the disclosure.
Figure 3:
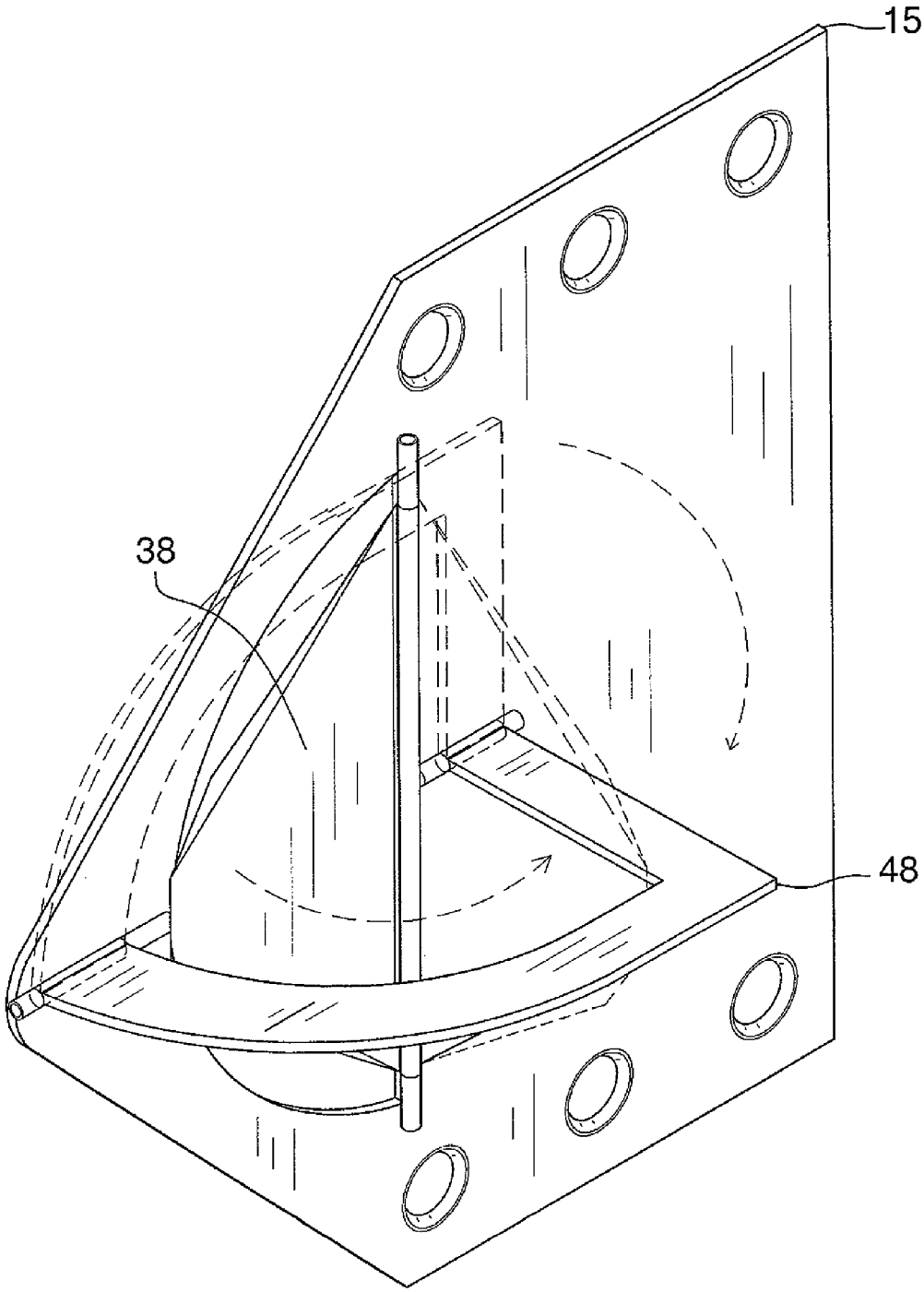
FIG. 3 is a front perspective view of an embodiment of the disclosure.
Figure 4:
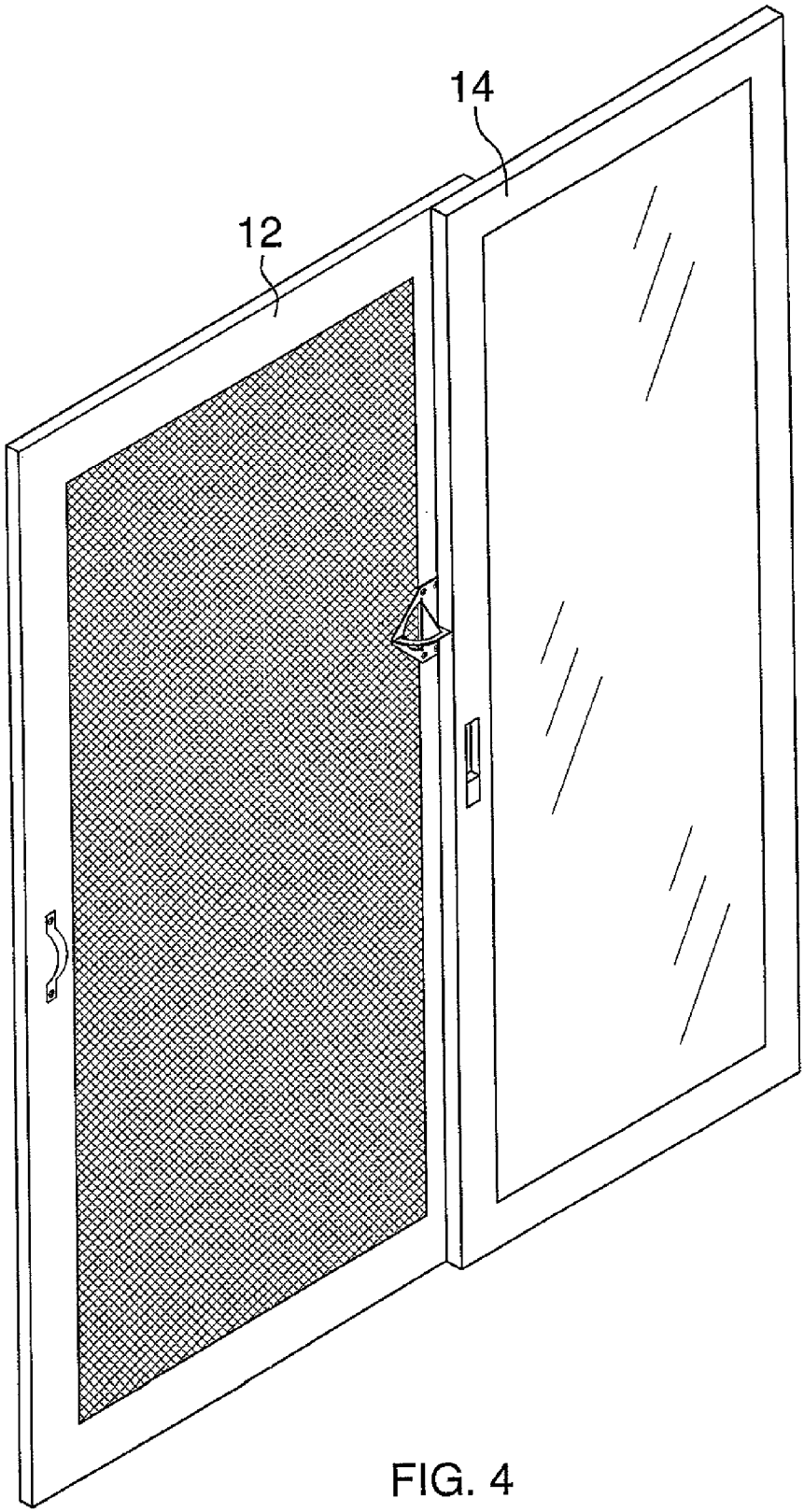
FIG. 4 is an in-use front perspective view of an embodiment of the disclosure.
Figure 5:
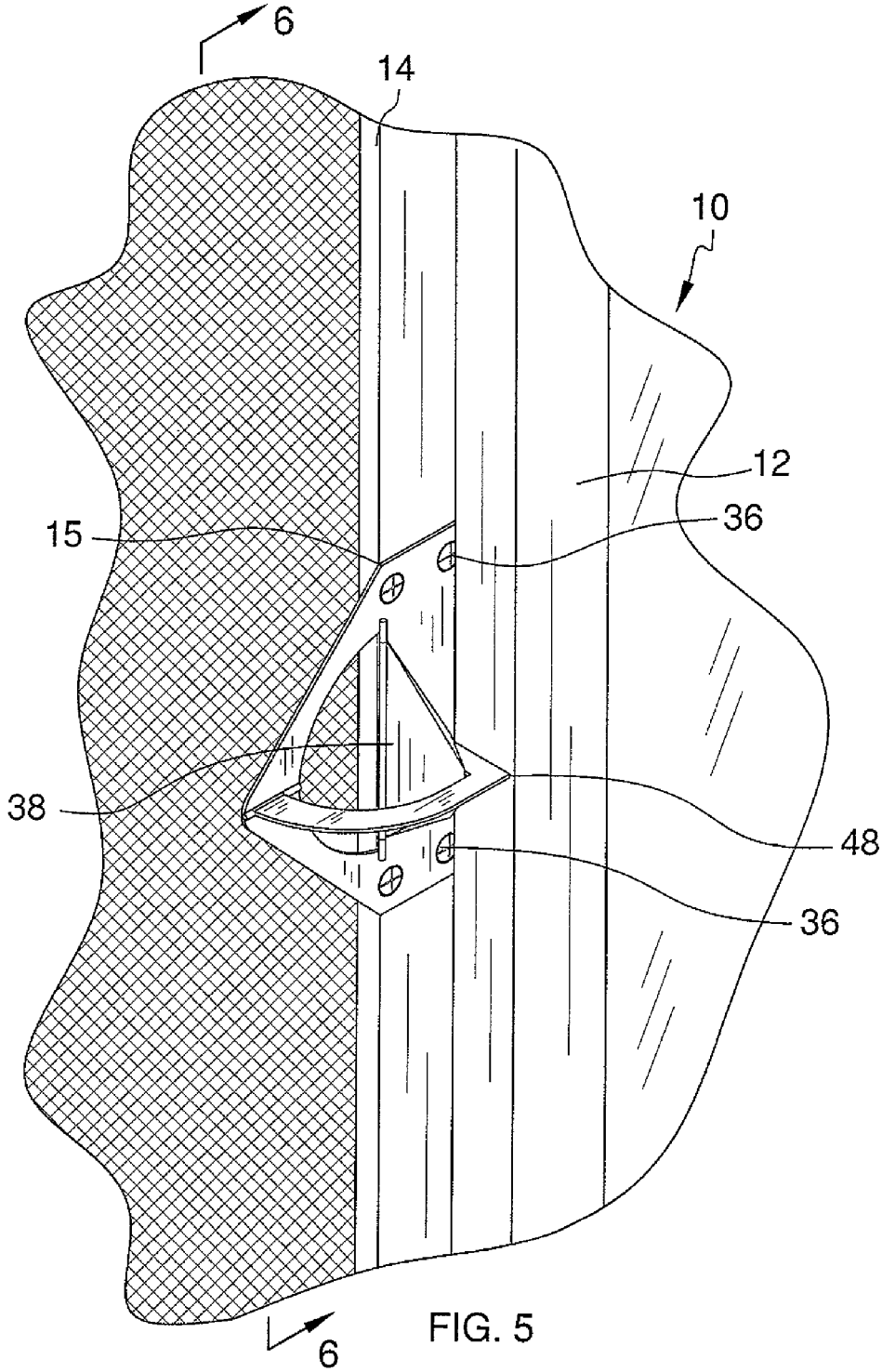
FIG. 5 is an enlarged in-use perspective view of an embodiment of the disclosure.
Figure 6:
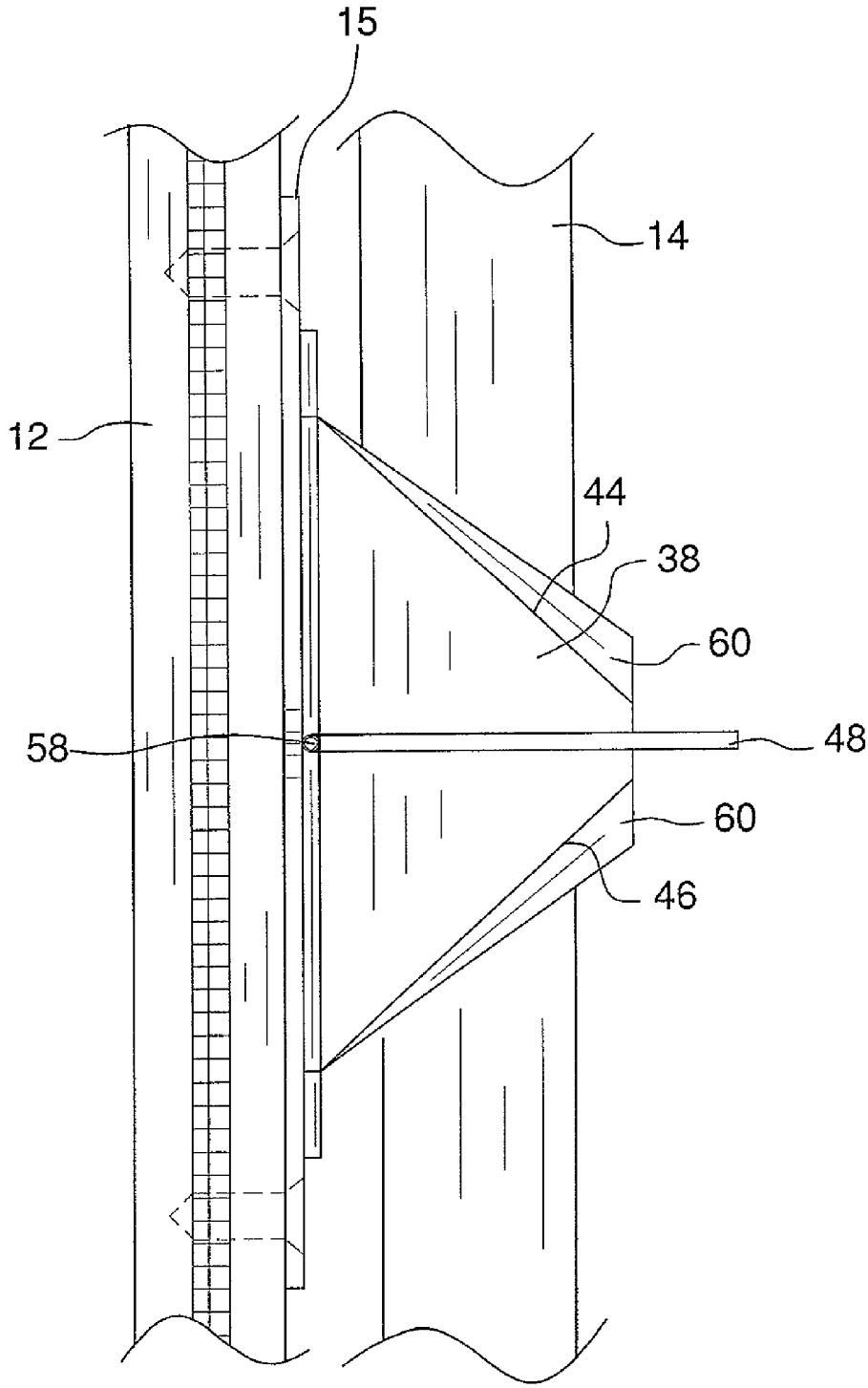
FIG. 6 is a side in-use view of an embodiment of the disclosure in a deployed position.
Figure 7:
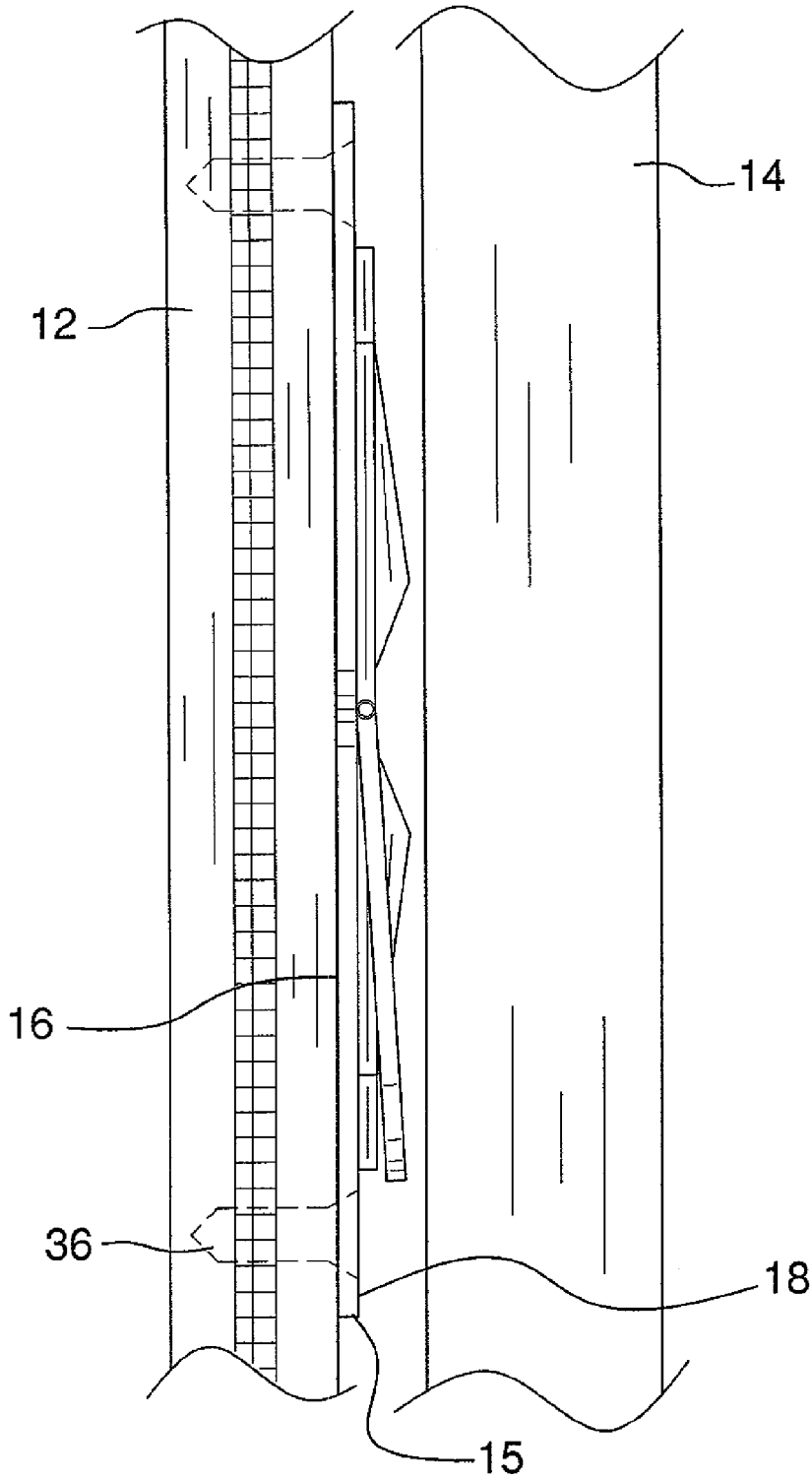
FIG. 7 is a side in-use view of an embodiment of the disclosure in a stored position.
Figure 8:
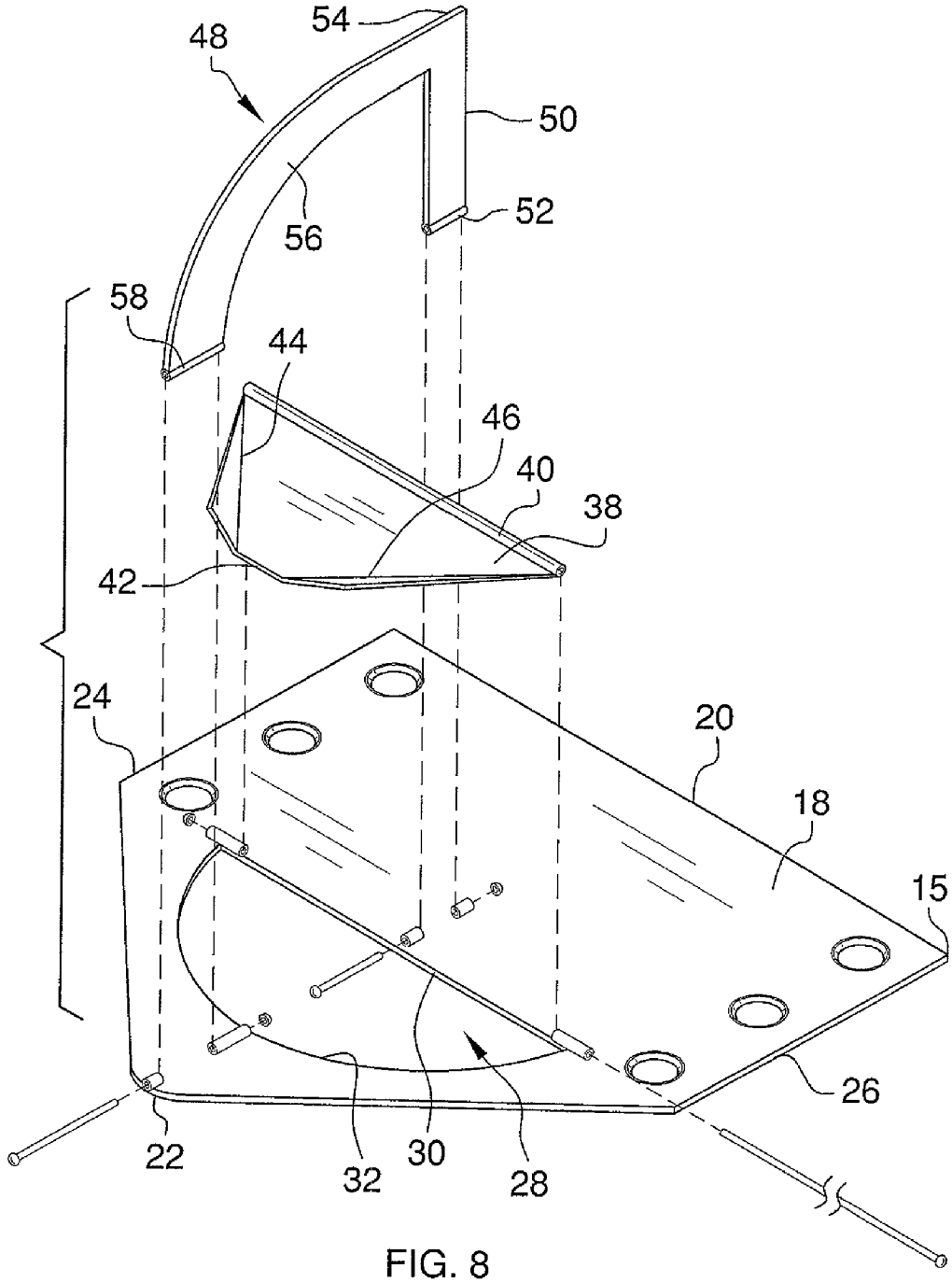
FIG. 8 is an exploded perspective view of an embodiment of the disclosure.

A hinge plate 38 has a hinged edge 40 that is hingedly coupled to the mounting plate 15 and a free edge 42 positioned opposite of the hinged edge 40. The hinge plate 38 is selectively positioned in a deployed position extending outwardly from the second side 18 as shown in FIG. 2. The hinge plate 38 is hingedly coupled to a perimeter edge of the aperture 28 to allow the hinge plate 38 to be placed in the aperture 28 and within a plane of the mounting plate 15. More particularly the hinge plate 38 is hingedly coupled to the linear edge 30 of the aperture 28. The hinge plate 38 has an upper edge 44 and a lower edge 46 that taper toward each other from the hinged edge 40 to the free edge 42.

A stop 48 includes a leg 50 that has a first end 52 and a second end 54 and an arcuate arm 56 is attached to the leg 50. The first end 52 of the leg 50 is hingedly coupled to the mounting plate 15 adjacent to the hinged edge 40 of the hinge plate 38. A distal end 58 of the arm 56 with respect to the leg 50 is hingedly coupled to the mounting plate 15 to position the hinge plate 38 between the first end 52 of the leg 50 and the distal end 58 of the arm 56. The stop 48 is pivotable from between positions lying against the second side 18 of the mounting plate 15 and a horizontal orientation extending outwardly from the second side 18 of the mounting plate 15. More particularly, the stop 48 is pivotable along an axis that is orientated perpendicular to the axis along which the hinge plate 38 is pivotable. The stop 48 releasably engages the hinge plate 38 when the hinge plate 38 is in the deployed position to retain the hinge plate 38 in the deployed position to prevent the sliding of the first 12 and second 14 doors with respect to each other.

The arm 56 has a shape which allows the hinge plate 38 to pivot when the stop 48 is in a horizontally orientated position. The free edge 42 is allowed to move along the arm 56 and to a juncture of the arm 56 and the leg 50. Here the free edge 42 may frictionally engage the stop 48 or a pair of flanges 60 may be included. The hinge plate 38 is additionally held in place by the vertical height of the free edge 42. Because the distance from the inner edge of arm 56 to the mounting plate 15 decreases as the arm is moved away from a horizontal orientation, or more particularly from an orthogonal orientation with respect to the mounting plate 15, inner edge of arm 56 will abut the free edge 42 as gravity pulls it downwardly and the free edge will prevent it from falling back to the mounting plate 15 as shown in FIG. 1. Each of the upper 44 and lower 46 edges may have a flange 60 thereon. The stop 48 is positionable on one of the flanges 60 when the hinge plate 38 is in the deployed position to retain the stop 48 in an orientation extending outwardly from the mounting plate 15.

Figure 9:
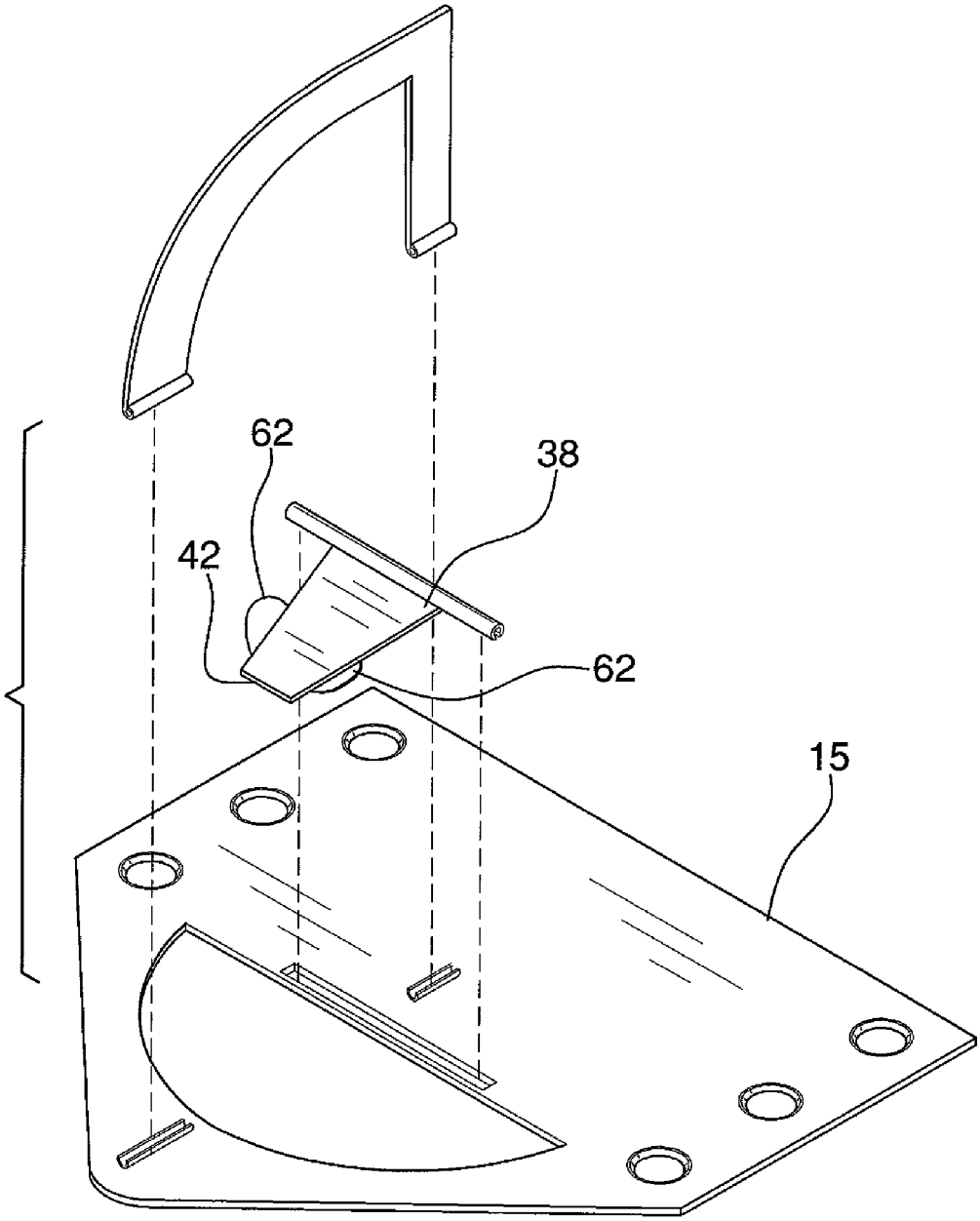
FIG. 9 is an exploded perspective view of an embodiment of the disclosure in a stored position.
Figure 10:
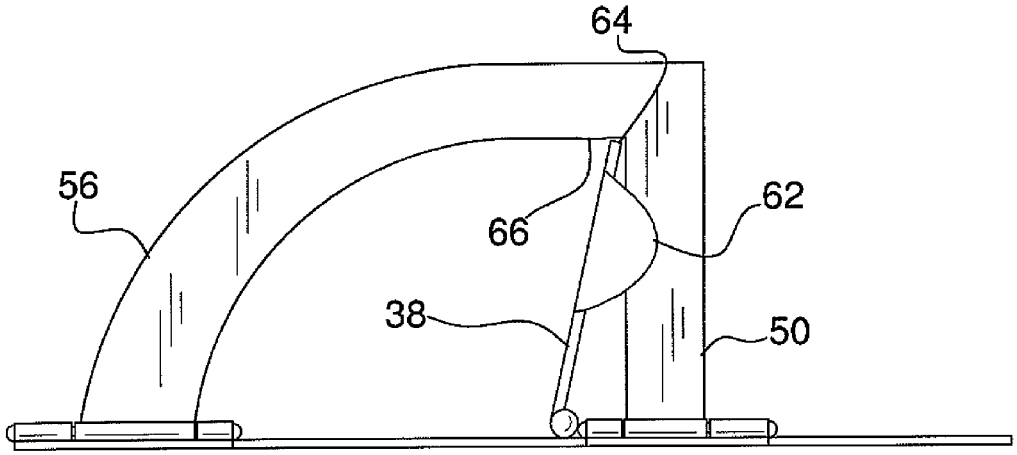
FIG. 10 is top view of an embodiment of the disclosure.

FIG. 9 shows a modified hinge plate 38 having a smaller size and which includes flexible finger gripping tabs 62 to facilitate the moving of the hinge plate 38. FIG. 10 shows a top view of this embodiment which may further include a notch 64 at a juncture of the arm 56 and the leg 50. The free edge 42 will engage the raised area 66 adjacent to the notch 64 as it moves toward the notch 64 to cause the free edge 42 to snap into the notch 64. This will help prevent the accidental movement of the hinge plate 38 relative to the stop 48. FIG. 9 also shows how the stop 48 and hinge plate 38 may be snappily coupled to the mounting plate 15.

In use, the leg 50 of the stop 48 is positioned to be adjacent to the second door 14 so that the first 12 and second 14 doors cannot slide without the second door 14 striking the stop 48 when the stop 48 is extended outwardly from the mounting plate 15. The stop 48, in this manner, prevents the first 12 and second 14 doors from moving with respect to each other. When the stop 48 is not being used to stop movement of the doors 12, 14, the hinge plate 38 is positioned within the aperture 28 and the stop 48 laid against on the second side 18 of the mounting plate 15 to allow the first 12 and second 14 doors to move freely with respect to each other.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A door locking system to prevent opening of a door, system comprising:

a first door and a second door being adjacent to each other, at least one of said first and second doors is a sliding door;

a mounting plate having a first side, a second side, a first lateral edge, a second lateral edge, an upper edge and a lower edge, said first side being attached to said first door at a position adjacent to said second door;

a hinge plate having a hinged edge being hingedly coupled to said mounting plate and a free edge positioned opposite of said hinged edge, said hinge plate being selectively positioned in a deployed position extending outwardly from said second side; and a stop including a leg having a first end and a second end and an arcuate arm being attached to said leg, said first end of said leg being hingedly coupled to said mounting plate adjacent to said hinged edge of said hinge plate, a distal end of said arm with respect to said leg being hingedly coupled to said mounting plate to position said hinge plate between said first end of said leg and said distal end of said arm, said stop releasably engaging said hinge plate when said hinge plate is in said deployed position to retain said hinge plate in said deployed position and preventing the sliding of the first and second doors with respect to each other.

2. The system according to claim 1, wherein said mounting plate has a plurality of mounting openings extending therethrough, each of a plurality of fasteners extending into one of said openings and said fasteners extending into said first door at a position adjacent to said second door.

3. The system according to claim 1, wherein said mounting plate has an aperture therein extending into said first side and outwardly of said second side, said hinge plate being hingedly coupled to a perimeter edge of said aperture to allow said hinge plate to be placed within a plane of said mounting plate.

4. The system according to claim 1, wherein further including said hinge plate having an upper edge and a lower edge, a pair of flanges, each of said upper and lower edges having a flange thereon, said stop being positionable on one of said flanges when said hinge plate is in said deployed position to retain said stop in an orientation extending outwardly from said mounting plate.

5. A door locking system to prevent opening of a door, system comprising:

a first door and a second door being adjacent to each other, at least one of said first and second doors is a sliding door;

a mounting plate having a first side, a second side, a first lateral edge, a second lateral edge, an upper edge and a lower edge, said mounting plate having an aperture therein extending into said first side and outwardly of said second side, said mounting plate having a plurality of mounting openings extending therethrough, each of a plurality of fasteners extending into one of said openings and said fasteners extending into said first door at a position adjacent to said second door;

a hinge plate having a hinged edge being hingedly coupled to said mounting plate and a free edge positioned opposite of said hinged edge, said hinge plate being selectively positioned in a deployed position extending outwardly from said second side, said hinge plate being hingedly coupled to a perimeter edge of said aperture to allow said hinge plate to be placed within a plane of said mounting plate;

a stop including a leg having a first end and a second end and an arcuate arm being attached to said leg, said first end of said leg being hingedly coupled to said mounting plate adjacent to said hinged edge of said hinge plate, a distal end of said arm with respect to said leg being hingedly coupled to said mounting plate to position said hinge plate between said first end of said leg and said distal end of said arm, said stop releasably engaging said hinge plate when said hinge plate is in said deployed position to retain said hinge plate in said deployed position and preventing the sliding of the first and second doors with respect to each other;

said hinge plate having an upper edge and a lower edge; and a pair of flanges, each of said upper and lower edges having a flange thereon, said stop being positionable on one of said flanges when said hinge plate is in said deployed position to retain said stop in an orientation extending outwardly from said mounting plate.

6. A door locking apparatus for mounting to a first door positioned adjacent to a second door wherein one of the first or second doors is a sliding door, said apparatus including:

a mounting plate having a first side, a second side, a first lateral edge, a second lateral edge, an upper edge and a lower edge, said first side being attachable to said first door at a position adjacent to said second door;

a hinge plate having a hinged edge being hingedly coupled to said mounting plate and a free edge positioned opposite of said hinged edge, said hinge plate being selectively positioned in a deployed position extending outwardly from said second side; and a stop including a leg having a first end and a second end and an arcuate arm being attached to said leg, said first end of said leg being hingedly coupled to said mounting plate adjacent to said hinged edge of said hinge plate, a distal end of said arm with respect to said leg being hingedly coupled to said mounting plate to position said hinge plate between said first end of said leg and said distal end of said arm, said stop releasably engaging said hinge plate when said hinge plate is in said deployed position to retain said hinge plate in said deployed position and preventing the sliding of the first and second doors with respect to each other.

7. A door locking apparatus according to claim 6, wherein said mounting plate has a plurality of mounting openings extending therethrough, each of a plurality of fasteners extending into one of said openings and said fasteners being extendable into said first door at a position adjacent to said second door.

8. A door locking apparatus according to claim 7, wherein said mounting plate has an aperture therein extending into said first side and outwardly of said second side, said hinge plate being hingedly coupled to a perimeter edge of said aperture to allow said hinge plate to be placed within a plane of said mounting plate.

9. A door locking apparatus according to claim 8, wherein further including said hinge plate having an upper edge and a lower edge, a pair of flanges, each of said upper and lower edges having a flange thereon, said stop being positionable on one of said flanges when said hinge plate is in said deployed position to retain said stop in an orientation extending outwardly from said mounting plate.

10. A door locking apparatus according to claim 6, wherein said mounting plate has an aperture therein extending into said first side and outwardly of said second side, said hinge plate being hingedly coupled to a perimeter edge of said aperture to allow said hinge plate to be placed within a plane of said mounting plate.

11. A door locking apparatus according to claim 6, wherein further including said hinge plate having an upper edge and a lower edge, a pair of flanges, each of said upper and lower edges having a flange thereon, said stop being positionable on one of said flanges when said hinge plate is in said deployed position to retain said stop in an orientation extending outwardly from said mounting plate.

* * * * *